US008163348B2

(12) United States Patent
Kloeckner et al.

(10) Patent No.: US 8,163,348 B2
(45) Date of Patent: Apr. 24, 2012

(54) CONTROLLED THICKNESS REDUCTION FOR HOT-DIP COATED, HOT-ROLLED STEEL STRIP AND INSTALLATION USED IN THIS PROCESS

(75) Inventors: Hans-Georg Kloeckner, Wesel (DE); Andreas Gramer, Solingen-Höhscheidt (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 754 days.

(21) Appl. No.: 11/885,727

(22) PCT Filed: Mar. 9, 2006

(86) PCT No.: PCT/EP2006/002155

§ 371 (c)(1),
(2), (4) Date: Sep. 7, 2007

(87) PCT Pub. No.: WO2006/097237

PCT Pub. Date: Sep. 21, 2006

(65) Prior Publication Data

US 2008/0193655 A1 Aug. 14, 2008

(30) Foreign Application Priority Data

Mar. 18, 2005 (DE) ..... 10 2005 013 103

(51) Int. Cl.
*B05D 1/18* (2006.01)

(52) U.S. Cl. ..... 427/329; 427/328; 427/431; 427/434.2; 427/435; 427/436

(58) Field of Classification Search ..... 427/8, 9, 427/430.1, 431, 434.2, 433, 435, 436
See application file for complete search history.

(56) References Cited

U.S. PATENT DOCUMENTS

| | | | | |
|---|---|---|---|---|
| 3,309,906 | A * | 3/1967 | Bernick et al. | 72/47 |
| 3,888,119 | A * | 6/1975 | Tanczyn | 72/364 |
| 5,512,321 | A | 4/1996 | Paramonov | |
| 6,205,643 | B1 | 3/2001 | Brinkmann | |
| 2003/0145914 | A1 * | 8/2003 | Brisberger et al. | 148/530 |
| 2005/0004695 | A1 * | 1/2005 | Cribbs et al. | 700/104 |

FOREIGN PATENT DOCUMENTS

| | | | |
|---|---|---|---|
| DE | 42 08 477 | | 9/1993 |
| DE | 101 46 791 | | 4/2003 |
| EP | 0 863 222 | | 9/1998 |
| EP | 0 884 402 | | 12/1998 |
| EP | 0 913 494 | | 6/1999 |
| EP | 1 312 692 | | 5/2003 |
| EP | 1 336 666 | | 8/2003 |
| EP | 1 336 666 | A1 * | 8/2003 |
| JP | 02298245 | | 1/1990 |
| JP | 05086448 | | 4/1993 |
| JP | 09279323 | | 10/1997 |
| JP | 2004002918 | | 1/2004 |
| WO | 02/14572 | | 2/2002 |

OTHER PUBLICATIONS

Ljambach et al: "Automated cold rolling process", 1981, pp. 172-177.

* cited by examiner

*Primary Examiner* — David Turocy

(74) *Attorney, Agent, or Firm* — Jonathan Myers; Andrew Wilford

(57) ABSTRACT

The invention relates to a method for hot-dip coating hot-rolled steel strip, during which the steel strip passes through a pickling station, a rinsing station, a drying station, a heating furnace and then through a molten bath. The final thickness and the thickness tolerance of the hot-dip coated steel strip are achieved by a controlled thickness reduction in a roll stand in the process line. The achievement of the finished thickness is controlled by at least one thickness measuring unit at the outlet of the roll stand, and deviations upward or downward therefrom are fed back in the form of an actuating signal for actuating the roll stand in order to appropriately increase or decrease the thickness reduction. The invention also relates to an installation for producing a steel strip of the aforementioned type.

9 Claims, No Drawings

CONTROLLED THICKNESS REDUCTION FOR HOT-DIP COATED, HOT-ROLLED STEEL STRIP AND INSTALLATION USED IN THIS PROCESS

CROSS REFERENCE TO RELATED APPLICATIONS

This application is the US national phase of PCT application PCT/EP2006/002155, filed 9 Mar. 2006, published 21 Sep. 2006 as WO 2006/097237, and claiming the priority of German patent application 102005013103.4 itself filed 18 Mar. 2005, whose entire disclosures are herewith incorporated by reference.

The present invention relates to a method for the controlled thickness reduction of hot-dip coated (=hot-dip finished), hot-rolled steel strip as well as to the corresponding installation, as will be elaborated upon in greater detail below.

At the present time, there are three ways to manufacture hot-dip coated products.

If stringent requirements are made of the surface quality and of the dimensional accuracy, a cold-rolled strip undergoes recrystallization annealing, subsequently hot-dip coating and then temper-pass rolling and/or stretcher-and-roller leveling.

In the case of similar requirements, a hot strip that has been previously hot-dip coated is reduced to dimensional accuracy on a separate cold-rolling mill.

As the third possibility, in cases when lesser requirements are made of the surface quality and of the dimensional accuracy, a hot strip is hot-dip coated after elimination of the mill scale and then undergoes temper-pass rolling and/or stretcher-and-roller leveling.

According to Stahl-Lexikon [Steel Lexicon], 25$^{th}$ Edition, published by Verlag StahlEisen, Düsseldorf, Germany, pages 134, 139, the term "temper-pass rolling" refers to cold rerolling, that is to say, a slight cold reduction of the strip following a preceding heat treatment or hot working, whereby the thickness reduction amounts to 0.5% to 3%.

European patent application EP 1 203 106 B1=U.S. Pat. No. 6,761,936=WO 01/011099 A2 discloses a method for the hot-dip galvanization of hot-rolled coated steel strip, whereby, in a first step, the strip is introduced into a pickling station, in a subsequent step, the strip is introduced into a rinsing station, then into a drying station, and in another step, it is introduced into a galvanizing furnace and galvanized, whereby the above-mentioned process steps are carried out under the hermetic exclusion of air and oxygen from the environment.

The present invention is based on the objective of being able to further process the strip directly in the processing line and to subject it to a special thickness reduction procedure when such hot-dip finished, hot-rolled strips are produced.

This objective is achieved by means of the characterizing features of the present method and installation.

Therefore, the present invention relates to a method for the hot-dip coating of a hot-rolled steel strip, whereby the steel strip passes through a pickling station, a rinsing station, a drying station, a heating furnace and then a melting bath, said method being characterized in that the final thickness and the thickness tolerance of the hot-dip coated steel strip are achieved by a controlled thickness reduction in a rolling-mill stand in the processing line, whereby at least one thickness gauge located in the exit of the rolling-mill stand checks whether the final thickness has been achieved and any deviations upwards or downwards are fed back as a control signal for the adjustment of the rolling-mill stand so that the thickness reduction can be correspondingly increased or decreased.

During temper-pass rolling according to the state of the art, the hot-dip finished strip undergoes lengthening in the processing line and thus a thickness reduction in a temper-pass rolling-mill stand, whereby the objective is to attain a uniform lengthening of the cross section of the strip along the length of the strip. To this end, for control purposes, the entering and exiting velocities are measured and evaluated as the measured quantity of a uniform lengthening or thickness reduction.

In contrast to this, the technological focal point of the method according to the invention lies in the systematic and controlled adjustment of the final thickness and of the tolerance in the rolling-mill stand in the processing line after the hot-dip finishing.

The difference from temper-pass rolling lies in the fact that, for instance, the thickness reduction in the rolling-mill stand increases when the entering thickness is increased in order to maintain the final thickness, and then the exiting velocity (at a constant entering velocity) rises. The same applies in the case of a thinner entering thickness. Therefore, a temper-pass rolling-mill stand does not use a thickness gauge for the regulation, while the method according to the invention does so in any case.

Moreover, when these different thickness-reduction methods are employed, they yield products that differ substantially from each other, as can be seen from the thickness recordings along the strip length of hot-strip coils in the temper-pass rolled state on the one hand (the state of the art), and in the method according to the invention on the other hand.

The above-mentioned thickness gauge is manufactured, for example, by Thermo Electron (Erlangen) GmbH in Erlangen, Germany and sold under the designation Radiometrie RM 200 EM together with the applicable software and hardware. These thickness gauges are preferably employed in the processing line immediately downstream from and especially also upstream from the hot-rolling-mill stand in order regulate the rolling force for the thickness-reduced hot-dip finished hot strip.

According to another preferred embodiment, a thickness gauge that measures the entering thickness of the steel strip and reports this value to the thickness regulation means of the rolling-mill stand is arranged upstream from the rolling-mill stand.

According to a preferred embodiment of the present method, the thickness reduction lies in a range of more than 2% to 30%, preferably 4% to 10%. With such thickness reductions, the thickness tolerance relative to the center of the strip is ±0.01 mm or better.

According to a preferred embodiment of the present invention, the thickness reduction takes place after the steel strip has cooled down to 25° C. to 55° C. [77° F. to 131° F.], especially 30° C. to 50° C. [86° F. to 122° F.].

The term steel strip in the sense of the present invention refers, for example, to hot-rolled mild steel for cold reduction as employed under the designations DD11 to DD14 in DIN EN 10 111, as well as to hot-rolled un-alloyed general-purpose constructional steel grades of the type described in DIN EN 10025.

According to another preferred embodiment, strip buffers are provided upstream and/or downstream from the rolling-mill stand so that the thickness regulation means can compensate for velocity fluctuations. Here, these are especially mini-strip buffers with which the occurring velocity fluctuations can be compensated for particularly well.

According to another preferred embodiment, at least one of the working rolls in the rolling-mill stand is smooth or else has a structured surface with a special finish and/or a stochastic or deterministic structure.

A cylindrical finish as well as a crowned finish can be employed as the special finish that plays a role according to the invention and that can be utilized as a function of the customer requirements.

In order to create rough surfaces on the steel strip, stochastic structures can be employed as known, for example, from the methods of shot-blast texturing (SBT), electro-discharge texturing (EDT), electrochemical texturing (ECT) and precision texturing (PRETEX® process of Salzgitter AG). Moreover, laser-texturing (LT) and electron-beam texturing (EBT) can be used to create deterministic crater-like structures on such working rolls.

According to another preferred embodiment, the thickness is reduced in the presence of a rolling fluid. Such a rolling fluid is either a volatilizing metal-working agent, demineralized water, synthetic rolling oil, or else a rolling emulsion, all of which improve the friction properties in the nip (friction conditions between the material being rolled and the rolls).

Such lubrication usually involves the application of an amount ranging from about 0.2 g/m$^2$ to 5 g/m$^2$.

According to another preferred embodiment, the hot-dip coating is a coating with a zinc or aluminum alloy. Examples cited are zinc, zinc-iron, zinc-aluminum, aluminum-zinc or aluminum-silicon, preference being given to zinc and zinc alloys.

According to another preferred embodiment, the passage through the pickling station, the rinsing station, the drying station and the melting bath takes place under the exclusion of air and oxygen. For the sake of avoiding repetitions, we hereby make reference to European patent specification EP 1 203 106 B2 of SMS Demag AG, Rn 0011-0025.

The subject matter of the present invention is also the provision of an installation to produce a special hot-dip coated, hot-rolled steel strip.

Therefore, the present invention relates to an installation for the production of a hot-dip coated, hot-rolled steel strip of the above-mentioned type, comprising a pickling station, a rinsing station, a drying station, a heating furnace and a melting bath, characterized in that a rolling-mill stand having at least one thickness gauge in the exit is provided in the processing line so as to preferably bring about a controlled thickness reduction of more than 2% to 30%, especially 4% to 10%, optionally in conjunction with the formation of a special finish and/or stochastic or deterministic structure of the steel strip.

The present invention will now be explained in greater detail with reference to an embodiment.

EXAMPLE 1

Controlled Thickness Reduction

Following a hot-dip coating of the above-mentioned type in a processing line, a hot-rolled mild steel for cold reduction bearing the designation strip EN 10111-DD11 underwent a controlled thickness reduction of approximately 6.5%. In this process, the yield point ($R_{p0.2}$) increased by up to 80 N/mm$^2$, the ultimate tensile strength ($R_m$) increased by up to 30 N/mm$^2$, in contrast to which the elongation of the steel strip ($A_{80}$, uniform elongation) was reduced by 10%, that is to say, from 30% down to 20%.

On this basis, the mild product strip EN 10111-DD11 yields a steel of galvanized quality, for example, DX51D of EN 10327 or S320GD of EN 10326, having the same material properties as a galvanized steel strip of the same designation according to the EN standard. During the controlled thickness reduction, the thickness along the strip length of the hot-strip coils was recorded.

Thus, over a length of 1,548 meters with a controlled thickness reduction, a mean plate thickness of 1.5 mm was achieved at a one-time maximum value of 1.588 mm and a minimum value of 1.497 mm at a 2-sigma tolerance of 0.014 mm.

COMPARATIVE EXAMPLE

Thickness Reduction by Means of Temper-Pass Rolling

Example 1 was repeated, except that, instead of a controlled thickness reduction, temper-pass rolling by 1% was performed. Like in Example 1, the thickness along the strip length of the hot-strip coils was recorded.

Thus, over a length of 1,455 meters, a mean thickness amounting to 1.704 mm was already achieved at a target value of 1.700 mm, at a maximum value of 1.809 mm and a minimum value of 1.664 mm and at a 2-sigma tolerance of 0.032 mm. This already shows that temper-pass rolling is considerably less advantageous than the controlled thickness reduction according to the invention.

A comparison of the characteristics shows that the thickness recordings along the strip length of the hot-strip coils in the temper-pass rolled state (state of the art) on the one hand and in the method according to the invention on the other hand differ considerably from each other and that the product obtained with the method according to the invention at a thickness reduction that is almost 6.5 times higher is a hot-strip coil exhibiting markedly smaller thickness tolerances.

The invention claimed is:

1. A method for the hot-dip coating of a hot-rolled steel strip EN 10111-DD11 to DD14 to increase its tensile strength, whereby the steel strip passes through a pickling station, a rinsing station, a drying station, a heating furnace and then a melting bath wherein the final thickness and the thickness tolerance of the hot-dip coated hot-rolled steel strip EN 10111-DD11 are achieved, after the hot-dip coated, hot-rolled steel strip EN 10111-DD11 to DD14 has cooled down to 25° C. to 55° C., by a controlled thickness reduction in a rolling-mill stand in the processing line, whereby at least one thickness gauge located in the exit of the rolling-mill stand checks whether the final thickness has been achieved and any deviations upwards or downwards are fed back as a control signal for the adjustment of the rolling-mill stand so that the thickness reduction can be correspondingly increased or decreased so that the controlled thickness reduction in the hot-dip coated, hot-rolled steel strip lies in a range of 6.5% to 10% and with such a thickness reduction, the hot-dip coated, hot-rolled steel strip EN 10111-DD11 to DD14 has a thickness tolerance relative to the center of the strip of +0.01 mm or better.

2. The method according to claim 1 wherein a thickness gauge that measures the entering thickness of the hot-dip coated, hot-rolled steel strip EN 10111-DD11 to DD14 and reports this value to the thickness regulation means of the rolling-mill stand is arranged upstream from the rolling-mill stand.

3. The method according to claim 1 wherein strip buffers are provided upstream and/or downstream from the rolling-mill stand so that the thickness regulation means can compensate for velocity fluctuations.

4. The method according to claim 1 wherein at least one of the working rolls in the rolling-mill stand is smooth or else has a structured surface with a special finish and/or a stochastic or deterministic structure.

5. The method according to claim 1 wherein the thickness is reduced in the presence of a rolling fluid.

6. The method according to claim 1 wherein the hot-dip coating is a coating with zinc or a zinc alloy.

7. The method according to claim 1 wherein the passage through the pickling station, the rinsing station, the drying station and the melting bath takes place under the exclusion of air and oxygen.

8. The method according to claim 1 wherein the controlled thickness reduction is 6.5%.

9. A method for the hot-dip coating of a hot-rolled steel strip EN 10111-DD11 to DD14 to increase its tensile strength with a zinc or aluminum alloy, whereby the steel strip passes through a pickling station, a rinsing station, a drying station, a heating furnace and then a melting bath wherein the final thickness and the thickness tolerance of the hot-dip coated hot-rolled steel strip EN 10111-DD11 to DD14 are achieved, after the hot-dip coated, hot-rolled steel strip EN 10111-DD11 to DD14 has cooled down to 25° C. to 55° C., by a controlled thickness reduction in a rolling-mill stand in the processing line, whereby at least one thickness gauge located in the exit of the rolling-mill stand checks whether the final thickness has been achieved and any deviations upwards or downwards are fed back as a control signal for the adjustment of the rolling-mill stand so that the thickness reduction can be correspondingly increased or decreased so that the controlled thickness reduction in the hot-dip coated, hot-rolled steel strip lies in a range of 6.5% to 10% and with such a thickness reduction, the hot-dip coated, hot-rolled steel strip EN 10111-DD11 to DD14 has a thickness tolerance relative to the center of the strip of +0.01 mm or better.

* * * * *